US009530550B2

(12) United States Patent
Huang et al.

(10) Patent No.: US 9,530,550 B2
(45) Date of Patent: Dec. 27, 2016

(54) REMOTE CONTROL KIT

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: Grand Mate Co., LTD., Taichung (TW)

( * ) Notice: Subject to any disclaimer, the term of this patent is extended or adjusted under 35 U.S.C. 154(b) by 15 days.

(21) Appl. No.: 14/520,695

(22) Filed: Oct. 22, 2014

(65) Prior Publication Data

US 2016/0118173 A1 Apr. 28, 2016

(51) Int. Cl.
*H01F 7/20* (2006.01)
*H01F 7/02* (2006.01)

(52) U.S. Cl.
CPC ..... *H01F 7/0252* (2013.01)

(58) Field of Classification Search
CPC ..... Y10S 211/01; H01F 7/0263; F16M 13/022
USPC ..... 335/285; 248/309.4
See application file for complete search history.

(56) References Cited

U.S. PATENT DOCUMENTS

| | | | | | |
|---|---|---|---|---|---|
| 2,521,885 | A * | 9/1950 | Vasquez | E05C 19/16 | 211/DIG. 1 |
| 3,713,614 | A * | 1/1973 | Taylor | F21L 4/005 | 248/205.3 |
| 4,405,108 | A * | 9/1983 | Muirhead | A47F 5/0823 | 211/70.6 |
| 4,825,526 | A * | 5/1989 | Shenier | A41F 1/002 | 24/303 |
| 5,142,746 | A * | 9/1992 | Morita | A41F 1/002 | 24/303 |
| 5,473,799 | A * | 12/1995 | Aoki | A45C 13/1069 | 24/303 |
| 6,216,888 | B1 * | 4/2001 | Chien | B23Q 3/1546 | 211/70.6 |
| 6,972,654 | B1 * | 12/2005 | Brock | B25B 11/002 | 335/285 |
| 8,234,509 | B2 * | 7/2012 | Gioscia | G06F 1/1632 | 320/107 |
| 2012/0104197 | A1 * | 5/2012 | Jensen | F16M 13/02 | 248/205.1 |
| 2012/0325695 | A1 * | 12/2012 | Schein | B25H 3/06 | 206/216 |

* cited by examiner

*Primary Examiner* — Alexander Talpalatski
(74) *Attorney, Agent, or Firm* — Tracy M. Heims; Apex Juris, PllC.

(57) ABSTRACT

A remote control kit includes a magnetic holder and a remote control, wherein the magnetic holder includes a magnet and a non-slip member which covers the magnet. The remote control includes a case and a ferromagnetic member therein. The magnetic holder is fixed on a wall where the remote control is ready to be placed. The ferromagnetic member of the remote control is made of a material selected form the group consisting of iron, cobalt, and nickel, and therefore the remote control can be attached onto the magnetic holder via magnetic force.

5 Claims, 3 Drawing Sheets

REMOTE CONTROL KIT

BACKGROUND OF THE INVENTION

1. Technical Field

The present invention relates generally to a remote control, and more particularly to a magnetic attachment remote control kit.

2. Description of Related Art

It's always annoying to try to find a missing remote control, and such things seem to inevitably happen from time to time. Especially if a remote control doesn't have a specific container for it to be received therein, it might be carelessly placed at any random location and then get covered by books, letters, or other stuff piled on the table.

Some remote controls are respectively paired with a container, which has a chamber with an opening, rails, slots, etc., and a remote control can be received in the chamber of a paired container through the opening thereof. However, the volume and shape of such a container is fixed, and therefore it is not compatible with larger or smaller remote controls. For manufacturers of remote controls, the manufacturing process is less flexible, and the cost is relatively higher due to the fact that a remote control can be only perfectly fitted into those containers which have a chamber of specific corresponding volume and shape.

BRIEF SUMMARY OF THE INVENTION

In view of the above, the primary objective of the present invention is to provide a remote control kit, wherein a remote control thereof can be placed at a certain location, and the remote control kit is also compatible with remote controls of different sizes.

The present invention provides a remote control kit, which includes a magnetic holder, and a remote control. The remote control includes a case and a ferromagnetic member, wherein the case has a chamber therein to receive the ferromagnetic member, and the remote control is attached to the magnetic holder via the magnetic force between the magnetic holder and the ferromagnetic member.

Whereby, the remote control kit is compatible with remote controls of larger or smaller sizes, and any ferromagnetic object can be attached onto the magnetic holder. The structure of the remote control kit is simpler than conventional containers. Therefore, the manufacturing process can be simplified, and the manufacturing cost can be reduced as well.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
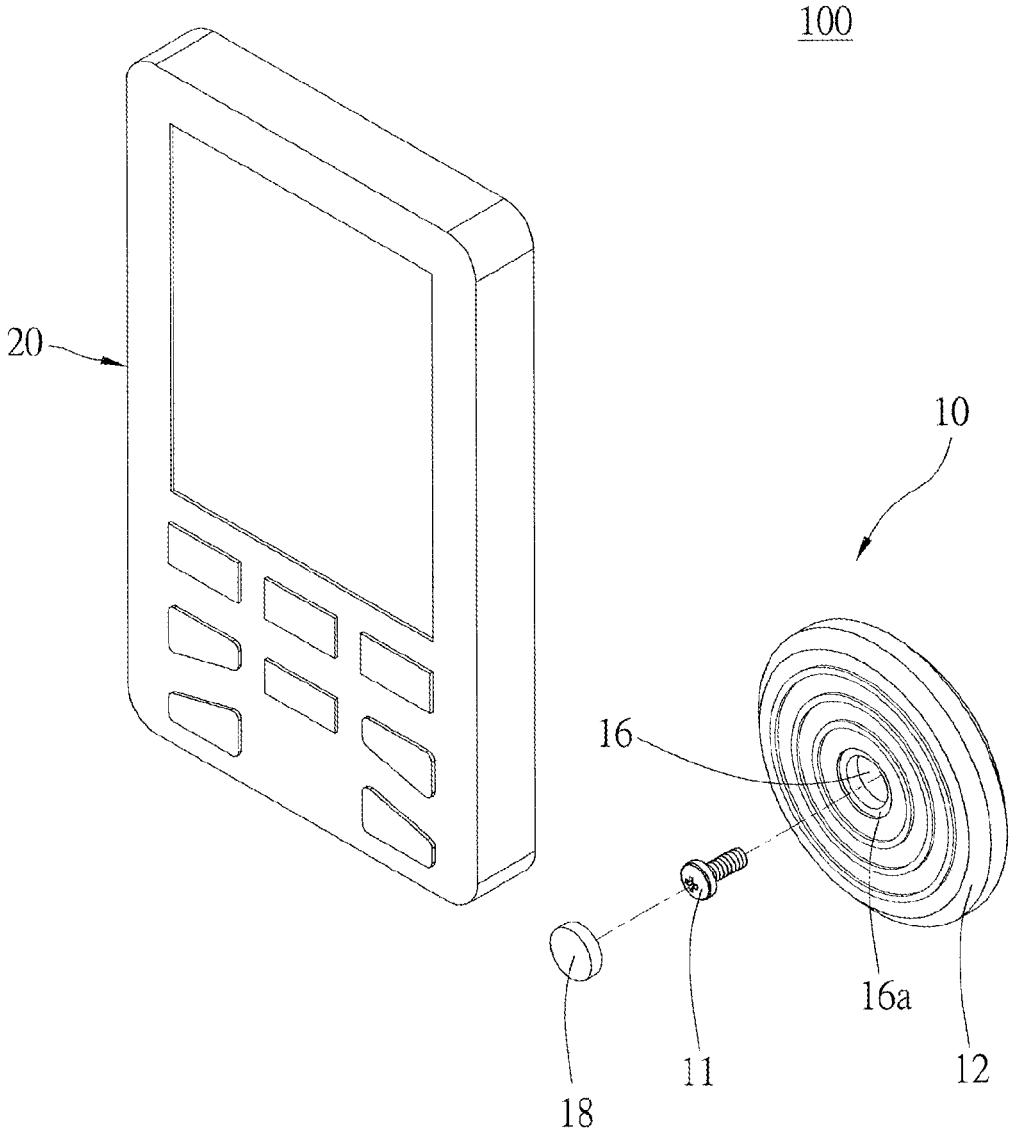
FIG. 1 is an exploded view of a first preferred embodiment of the present invention.
Figure 2:
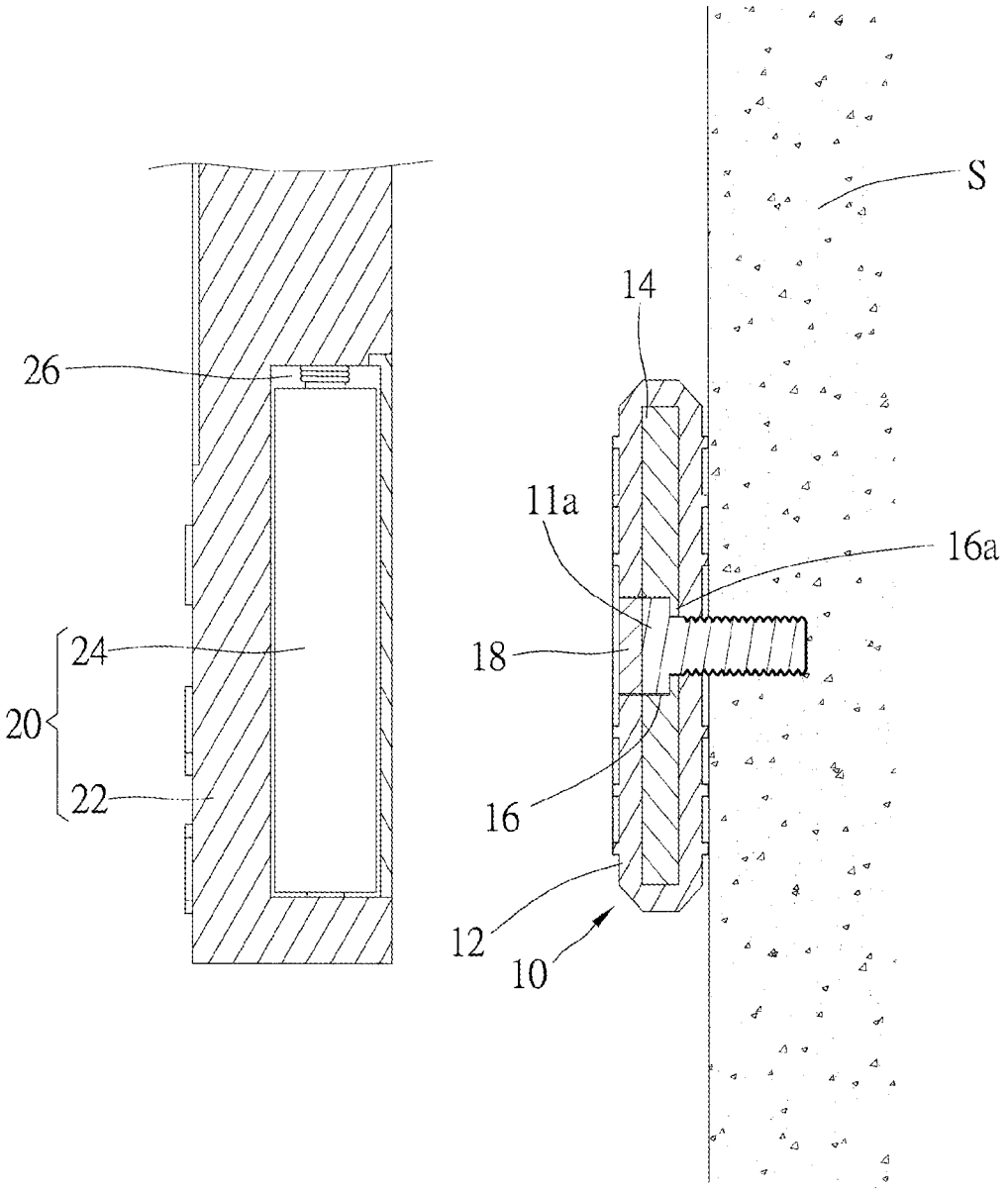
FIG. 2 is a sectional view of the first preferred embodiment of the present invention.

As shown in FIG. 1 and FIG. 2, a remote control kit 100 of the first preferred embodiment of the present invention includes a magnetic holder 10 and a remote control 20. The magnetic holder 10 has a non-slip member 12 and a magnet 14, wherein the non-slip member 12 is made of a non-slip rubber material, and the magnet 14 is covered by the non-slip member 12. The magnetic holder 10 further has a bore 16, an engaging member, and a cap 18, wherein the bore 16 goes through the non-slip member 12 and the magnet 14, and an abutting portion 16*a* is formed on a sidewall of the bore 16. In the first preferred embodiment, the abutting portion 16*a* is formed on the magnet 14. In addition, the engaging member is a screw 11, which is not a limitation of the present invention. The screw 11 is inserted into the bore 16 and screwed into a fixture M (e.g., a wall of a building) to fix the magnetic holder 10 on the fixture M, wherein a head 11*a* of the screw 11 abuts against the abutting portion 16*a*. The cap 18 is plugged into the bore 16 to cover the screw 11 for aesthetic reasons.

The remote control 20 includes a case 22 and a ferromagnetic member. The case 22 has a chamber 26 therein, while the ferromagnetic member is a battery 24 in the first preferred embodiment, which is received in the chamber 26. The material of an outer case of the battery 24 is selected from the group consisting of iron, cobalt, and nickel, and since these materials are ferromagnetic, when the remote control 20 is drawn near the magnetic holder 10, the outer case of the battery 24 and the magnet 14 of the magnetic holder 10 attract each other, and the remote control 20 can be attached onto the magnetic holder 10 as a result. Furthermore, the non-slip member 12 has an uneven surface, which includes a series of concentric rings in the first preferred embodiment, to provide larger friction between the remote control 20 and the magnetic holder 10, which reduces the chances of falling off. In practice, the non-slip member 12 can have multiple bumps thereon too.

It is worth mentioning that the remote control 20 is not necessary to be provided with other ferromagnetic members since the battery 24 is ferromagnetic in itself. Therefore the manufacturing cost can be reduced.

Figure 3:
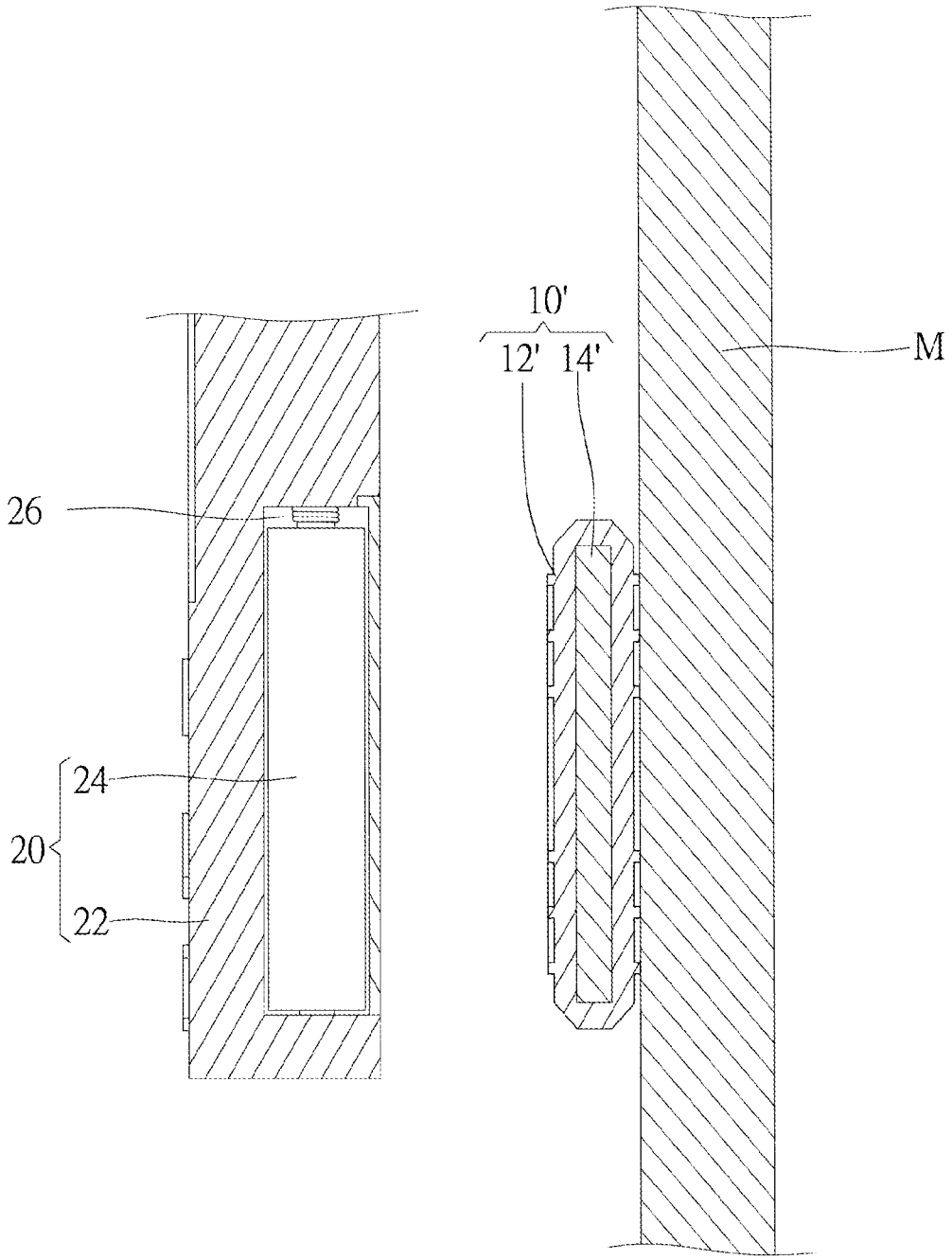
FIG. 3 is a sectional view of a second preferred embodiment of the present invention.

As shown in FIG. 3, a remote control kit of the second preferred embodiment of the present invention includes a magnetic holder 10', which similarly has a non-slip member 12' and a magnet 14'. The difference between the two preferred embodiments is that the magnetic holder 10' does not have a bore 16 as mentioned above, and it is attached to a surface of a magnetic fixture, such as a refrigerator or a whiteboard, by magnetic force directly.

It must be pointed out that the embodiments described above are only some preferred embodiments of the present invention. All equivalent structures which employ the concepts disclosed in this specification and the appended claims should fall within the scope of the present invention.

What is claimed is:

1. A remote control kit, comprising:

a magnetic holder, and a remote control including a case and a ferromagnetic member comprising a battery, wherein the case has a chamber therein to receive the ferromagnetic member, and the remote control is attached to the magnetic holder via the magnetic force between the magnetic holder and the ferromagnetic member;

wherein the remote control is detachably secured to the magnetic holder solely by the magnetic force between the battery and a magnet of the magnetic holder has sufficient strength to secure the remote control.

2. The remote control kit of claim 1, wherein a part of the battery is made of a material selected from the group consisting of iron, cobalt, and nickel.

3. The remote control kit of claim 1, wherein the magnetic holder includes a non-slip member which covers the magnet.

4. The remote control kit of claim 3, wherein the non-slip member is made of rubber.

5. The remote control kit of claim 1, further comprising an engaging member, wherein the magnetic holder has a bore for the engaging member to be inserted therethrough to engage the magnetic holder onto a fixture; the magnetic holder has a cap which covers the bore.

* * * * *